US005478272A

United States Patent [19]

Cozzini et al.

[11] Patent Number: 5,478,272

[45] Date of Patent: Dec. 26, 1995

[54] BLADE SHARPENING APPARATUS

[75] Inventors: Ivo Cozzini, Lincolnwood; Tom Spino, Gurnee; Johnathan Lopez, Skokie, all of Ill.

[73] Assignee: Cozzini, Inc., Chicago, Ill.

[21] Appl. No.: 271,189

[22] Filed: Jul. 7, 1994

[51] Int. Cl.[6] ..... B24B 33/00

[52] U.S. Cl. ..... 451/540; 451/486; 451/555

[58] Field of Search ..... 451/552, 553, 451/555, 540, 557, 461, 486; 76/82, 86, 88, 82.2

[56] References Cited

U.S. PATENT DOCUMENTS

| | | | |
|---|---|---|---|
| 578,440 | 3/1897 | Beaudin . | |
| 1,041,631 | 10/1912 | Johnson . | |
| 1,570,083 | 1/1926 | Runzi . | |
| 1,851,520 | 3/1932 | Moller . | |
| 1,909,743 | 5/1933 | Blanker . | |
| 2,124,646 | 7/1938 | Barsch . | |
| 2,544,193 | 3/1951 | Trapani et al. | 761/82.2 |
| 2,767,530 | 10/1956 | Paldanius . | |
| 2,885,836 | 5/1959 | Robitaille . | |
| 4,530,188 | 7/1985 | Graves | 451/555 |
| 4,550,632 | 11/1985 | Inman . | |
| 4,624,079 | 11/1986 | Bonapace . | |
| 4,934,110 | 6/1990 | Juranitch . | |
| 5,040,435 | 8/1991 | Millman | 451/553 |
| 5,046,385 | 9/1991 | Cozzini . | |
| 5,163,251 | 11/1992 | Lee . | |

FOREIGN PATENT DOCUMENTS

| | | |
|---|---|---|
| 190414 | 6/1957 | Germany . |
| 293785 | 3/1928 | United Kingdom . |
| 517242 | 8/1939 | United Kingdom . |

*Primary Examiner*—Bruce M. Kisliuk
*Assistant Examiner*—Derris Banks
*Attorney, Agent, or Firm*—Lee, Mann, Smith, McWilliams, Sweeney & Ohlson

[57] ABSTRACT

An apparatus for sharpening a blade is provided having a base member with a slot for receiving and guiding a blade to be sharpened, first and second apertures disposed on either side of the slot, first and second resilient biasing members disposed within each of the first and second apertures such that each of the biasing members is substantially entirely enclosed within the base member and protected from debris and contaminants. Sharpening members are connected to the biasing members and are rotatable about a central axis of each respective aperture between a first and second position, which rotation is limited by a stop member as the blade passes from one end of the slot toward the other.

14 Claims, 2 Drawing Sheets

BLADE SHARPENING APPARATUS

BACKGROUND OF THE INVENTION

1. Field of the Invention

The present invention relates to an apparatus for sharpening a cutting edge on a blade which has dulled. From time to time it becomes necessary to straighten, realign and sharpen the microscopic edge of a cutting tool such as a knife. It is important to maintain a uniform pressure and a proper even edge angle when sharpening a cutting edge. Previous sharpening devices have involved complex implements which commonly remove material from the cutting edge. Additionally, many of the previous devices are designed for use either by a right handed or left handed person while sharpening one side of the edge at a time, not both. The present invention relates to a sharpener having a substantially enclosed biasing assembly that resists contamination during use and provides for improved cleaning.

2. Description of the Prior Art

Devices for sharpening blades and the like fall into three broad categories:

(a) devices having sharpening elements in permanent fixed relationship such as that disclosed in U.S. Pat. Nos. 578,440; 1,851,520; 1,909,743; 2,767,530 and 5,163,251;

(b) devices having sharpening elements in movable relationship to each other with fully exposed biasing assemblies such as that disclosed in U.S. Pat. No. 4,934,110; and (c) devices having sharpening elements in movable relationship to each other with biasing assemblies not shielded from debris such as that disclosed in U.S. Pat. Nos. 1,041,631; 1,570,083; 2,124,646; 2,885,836; 4,550,632; and 4,624,079 as well as Patent Nos. GB 293,785 and GB 517,242.

There are problems and limitations with all of these devices. Devices having sharpening elements in fixed relationship to each other are relatively inefficient, needing considerably more resistance when passing a blade between the elements in order to sharpen the blade and may not provide optimal sharpening of the blade. These arrangements often remove perceptible metal fragments from the blade which shortens the useful blade life and is undesirable for contamination reasons.

In movable element arrangements exposed biasing means such as counterweights, lever arms, springs and the like, are prone to collect food particulates and other debris during use. These sharpening devices are often used in food processing plants where the blades to be sharpened are full of meat particles. Where the spring is not shielded from debris that may accumulate during use, this condition can cause related problems of contamination and disease.

In certain food industries, governmental authorities regulate and inspect the processing of food for sale to consumers. While many sharpening devices provide a sharp knife, these known devices have disadvantages of exposed parts or configurations that collect debris and contribute to the problems of contamination and disease. Additionally, cleaning the exposed parts of known devices is costly as these require specific attention to the meshed windings of springs and counterweights and the like. Cleaning may require disassembly of the housing in order to clean the apparatus and remove the debris. Sometimes when an operator is using prior art devices the operator may be of the misconception, in not seeing the debris that is collecting, that all is well and the apparatus does not need cleaning, which in fact is not the case. Thus, there is a need for a blade sharpening apparatus of the present invention that eliminates operator error due to unseen contamination, reduces cleaning and maintenance costs, and eliminates contamination thereof.

SUMMARY OF THE INVENTION

The present invention provides a blade sharpening apparatus with a base member having a front face and a rear face. The base member has a slot adapted to receive and guide a blade to be sharpened. The base member also has first and second apertures, one disposed on either side of the slot. Within the apertures are disposed a pair of resilient biasing members with each of the biasing members being substantially entirely enclosed within the base member. A first sharpening member is connected through a rotatable post to one of the resilient biasing members and is rotatable about a central axis of the first aperture with a first stop member adapted to limit the rotational movement of the first sharpening member in one direction. A second sharpening member is connected through a rotatable post to the second resilient biasing member and is rotatable about a central axis of the second aperture having a second stop member adapted to limit the rotational movement of the second sharpening member in one direction. The resilient biasing members are oriented so as to urge the respective sharpening members to a first position in which each of the sharpening members lies across a plane passing through the slot. The sharpening members when in the first position define a V-shaped intersection overlying the slot. The first and second resilient biasing members are further operative to allow rotation of the respective sharpening members from the first position to a second position as the blade passes from one end of the slot toward the other. The resilient biasing members are enclosed within the base member and protected from debris and contaminants.

DESCRIPTION OF THE PREFERRED EMBODIMENT

Figure 1:
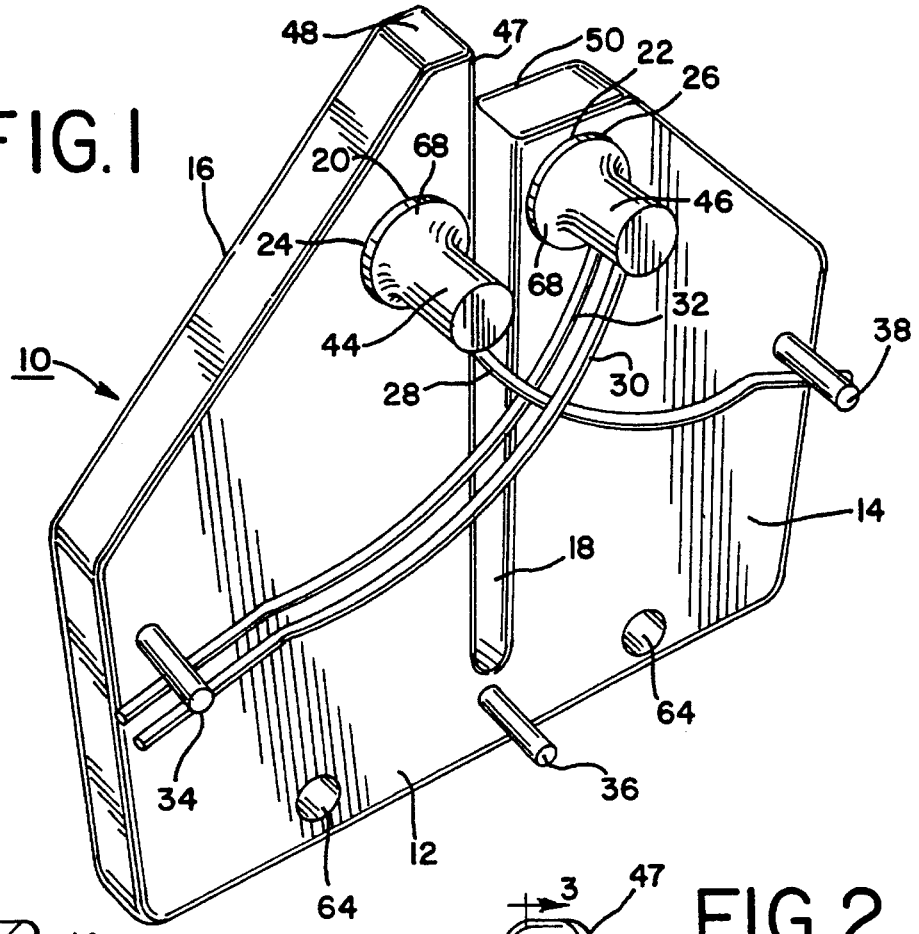
FIG. 1 is a perspective view illustrating a blade sharpening apparatus according to one embodiment of the present invention.
Figure 3:
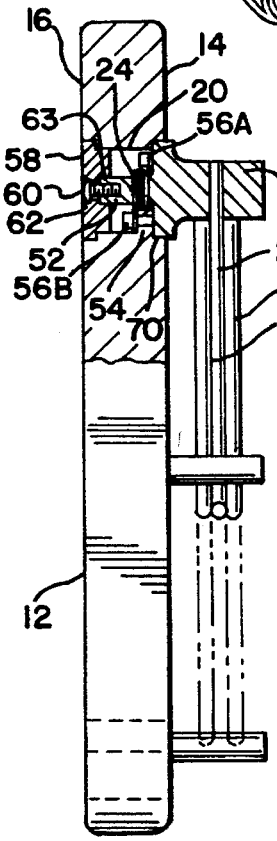
FIG. 3 is a side view, taken along lines 3—3 of FIG. 2.
Figure 2:
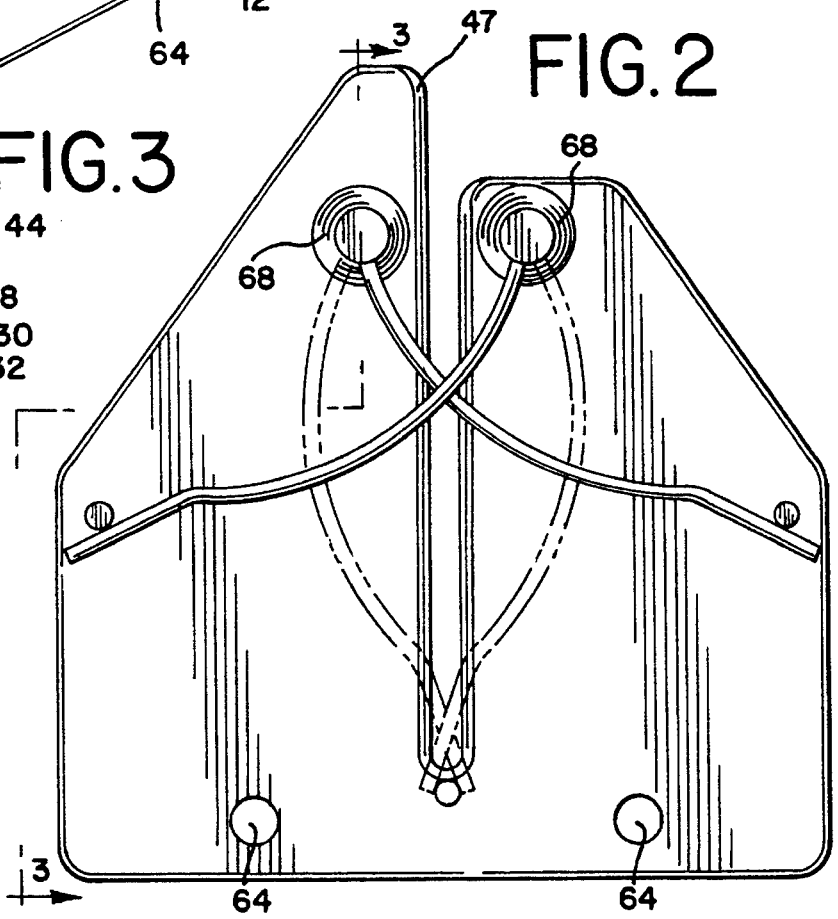
FIG. 2 is a front view illustrating the blade sharpening apparatus of FIG. 1.

Referring to FIGS. 1–3, a first embodiment of a blade sharpening apparatus of the present invention is generally designated as 10. Throughout the following description, like elements will be referred to using the same reference numbers whenever possible. The blade sharpener 10 generally includes a base member 12 having a front face 14 and a rear face 16. A slot 18 is formed in the base member for receiving and guiding a blade during sharpening. The base member 12 also includes a pair of apertures 20 and 22 for receiving and substantially entirely enclosing a pair of biasing members 24 and 26 so as to protect them from debris and other particulates during use. The blade sharpener 10 of FIGS. 1–3 includes first, second and third sharpening members 28, 30 and 32, which are used to sharpen the cutting edge of a knife blade or other cutting tools such as a scissors, shears or hedge trimmer.

The base member 12 is provided with stop members 34, 36 and 38 which are configured to control and limit the rotation of the sharpening members 28, 30 and 32 between a first "at rest" position, as illustrated by the solid lines in FIG. 2, and a second position as illustrated by the dotted lines in FIG. 2. Rotatable posts 44 and 46 extend outwardly from the front face 14 of the base member and are rotatable about a central axis of the apertures 20 and 22 respectively. Sharpening rods 30 and 32 are secured to post 46 for rotation therewith and sharpening rod 28 is secured to post 44.

The base member 12 is generally formed of a hard durable plastic such as polypropylene which is easily cleaned by water and/or a cleansing solution. The base member 12 can be formed of any desired shape. The embodiment of FIGS. 1–3 includes an offset step 47 between wall portions 48 and 50 so as to allow a blade to be easily positioned at the upper portion of the slot 18. The wall portion 48 is configured to be higher than the wall portion 50 which is advantageous for a right-handed worker to contact the broad portion of a blade against the step 47 and slide it down through the slot 18. Likewise, the present invention equally can be formed in a mirrored configuration for a left-handed operator.

The sharpening members 28, 30 and 32 are manufactured from suitable material to sharpen a blade, such as, 440 C stainless steel hardened to 59–60 Rockwell C Standard by heat treating or the like. The sharpening members 28, 30 and 32 are illustrated as curved in shape but can also be straight as shown in the embodiments of FIGS. 4–7. The embodiment of FIGS. 1–3 illustrates three sharpening rods, which is preferable, but either of rods 30 or 32 could be eliminated resulting in an apparatus having only two sharpening rods, one extending across the slot 18 from each side thereof. Also embodiments can be constructed having more than three sharpening rods if desired. The rods 30 and 32 are mounted parallel to each other but are spaced apart to define a gap therebetween through which the sharpening rod 28 extends.

The stop members 34, 36 and 38 can be manufactured from steel, plastic, or other suitable material as is known in the art to be durable and to withstand the rigors of use.

The biasing members 24 and 26 can be made from rotary coil torsion springs having two free ends. In the preferred embodiment each torsion spring provides approximately 0.51–0.55 pound-inches of torque to the rotatable posts 44, 46 and the sharpening members 28, 30 and 32 respectively connected thereto. The torsion spring should preferably be selected to provide such biasing torque although other tensions and torque specifications are contemplated depending on the desired application. Other resilient biasing mechanisms capable of accomplishing the same result could be substituted for the torsion spring mechanism.

FIG. 3 illustrates how the biasing member 24 is entirely enclosed within the base member 12 which prevents the accumulation of debris, particulates and other contaminants and which advantageously makes the present invention ideally suitable for industrial use.

As best shown in FIG. 3, the post 44 includes a stem 52 extending from one end. The same stem is present on post 46 which is identical in structure to post 44. Disposed within the aperture 20 is a flange 54 configured so that the spring 24 is positioned concentrically over the stem 52. The spring 24 has a pair of free ends, one of which is fastened to the post 44, and the other of which is connected to the flange 54, by suitable fasteners 56A and 56B respectively.

The blade sharpening apparatus 10 further includes rear cover portions 58 for sealing the apertures 20 and 22 on the rear face of the base member 12. FIG. 3 illustrates one such cover portion but both are identical in configuration. The cover portions 58 are located on the opposite side of the posts 44 and 46. The rear cover portions 58 include a central bore 62 and a recess 63 which receives the stem 52. A screw 60 passes through the central bore 62 and is secured into the end of stem 52, thereby sealing the apertures 20 and 22 on the rear face thereof and securing the rotatable posts 44, 46 in place. In this manner, the posts 44 and 46 are secured to the base member 12 and able to rotate with their associated sharpening members. The rear cover portions 58 enclose the biasing members 24 and 26 shielding these from contaminants during use.

The base member 12 further includes mounting holes 64 so that the blade sharpening apparatus 10 can be secured to a work station, countertop, machine, assembly line or the like.

The posts 44 and 46 can be formed from DELRIN plastic or other suitable material as will be apparent to one skilled in the art. The posts 44 and 46 both include a front cover portion 68 in the form of a skirt which is provided to overlie and seal the apertures 20 and 22 on the front face 14 of the base member 12. The front cover portion 68 is rotatably received in a recess 70 formed within the apertures 20 and 22.

In operation, a blade is positioned at the top of slot 18 and passed downwardly to the bottom. At the top of the slot the handle or hilt end of the blade is positioned close to the front face 14, while the pointed end of the blade extends well beyond the rear face 16, depending on the length of the knife. As the blade is drawn from the top of the slot to the bottom, it is also drawn horizontally through the slot so the entire length of the blade is sharpened from the hilt to the point. The sharpening members 28, 30 and 32 contact and sharpen the cutting edge of the blade. As the blade moves downwardly the sharpening members rotate and move downwardly with the blade against the torque of biasing members 24 and 26. The sharpening members 28, 30 and 32 rotate from the first position as shown in full lines in FIG. 2 to the second position shown in dotted lines when the blade passes from top to bottom. The sharpening members 30 and 32 extend downwardly and across slot 18 from right to left, as shown in FIG. 2, while blade 28 extends downwardly and across slot 18 from left to right. The blades intersect in a V-shape to lie across a plane passing through the slot.

Figure 5:
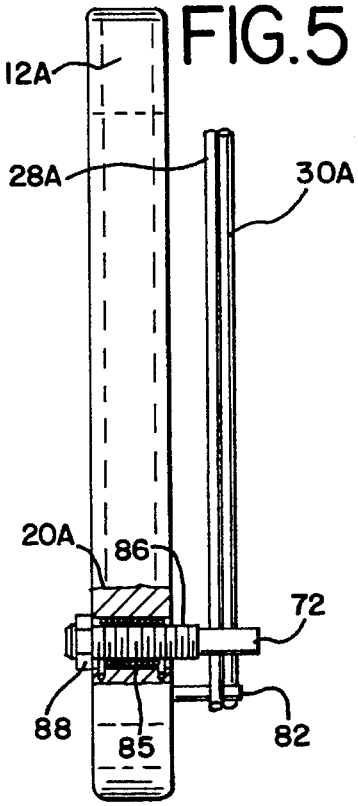
FIG. 5 is a side view, taken along lines 5—5 of FIG. 4.
Figure 4:
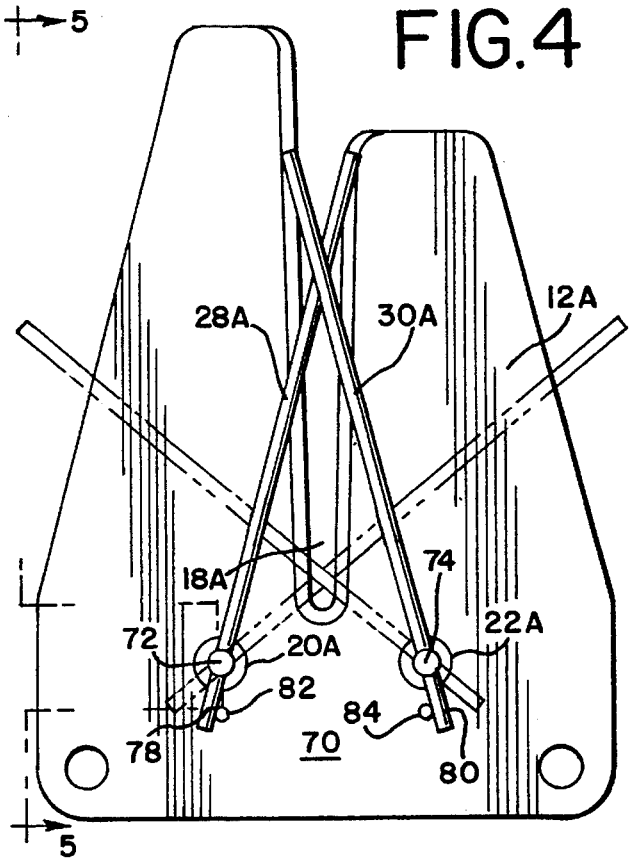
FIG. 4 is a front view illustrating a blade sharpening apparatus of another embodiment of the present invention.

FIGS. 4 and 5, illustrate another embodiment of a blade sharpening apparatus 70 incorporating the features of the present invention. The blade sharpener 70 generally includes a base member 12A having a slot 18A with a pair of apertures 20A and 22A located at the lower portion of slot 18A. Sharpening members 28A and 30A are secured in rotatable posts 72 and 74 which extend through apertures 20A and 22A. In this embodiment the sharpening members 28A and 30A are straight and adapted to be secured in the posts 72 and 74 with segments 78 and 80 extending therefrom. The segments 78 and 80 abut stop members 82 and 84 when the apparatus 70 is in the "at rest" position illustrated in full lines in FIG. 4. Each post 72, 74 includes a threaded portion 86, and a rear nut 88 which secures each post within the respective aperture 20A or 22A. A biasing member 85, illustrated as a coil spring, is concentrically mounted over each post 72, 74. The coil spring 85 is shown in FIG. 5 as having one free end constrained by a wall of the apertures 20 and 22 with the other end connected to the post 72 such that the sharpening members are biased to assume a first position shown in full lines in FIG. 4. The resilient biasing member 85 is substantially entirely enclosed within respective apertures 20A and 22A by the nut 88 on the rear face and the threaded portion 86 on the front face. A skirted cover portion (not shown) may be placed on the front face 14A similar to the front cover portion 68 illustrated in FIG. 1. The major distinction between the embodiment shown in FIGS. 1–3 and the embodiment of FIGS. 4 and 5 has to do with the orientation of the sharpening members. In the preferred embodiment of FIGS. 1–3, the sharpening members are mounted toward the top of the slot and extend downwardly across the slot. In the embodiment of FIGS. 4 and 5, the sharpening members are mounted toward the bottom of the slot and extend upwardly across the slot.

In operation, the biasing members of FIGS. 4 and 5 position the sharpening members 28A and 30A in the full line position as shown in FIG. 4. The blade is inserted into the upper portion of slot 18A and, by a downward and simultaneous horizontal movement, the sharpening members 28A and 30A are rotated by the motion of the blade to the second position, shown in phantom in FIG. 4, as the blade is sharpened. Upon removal of the blade from the slot the resilient biasing members 85 rotate the posts 72 and 74 to return the sharpening members 28A and 30A to the first position.

Figure 7:
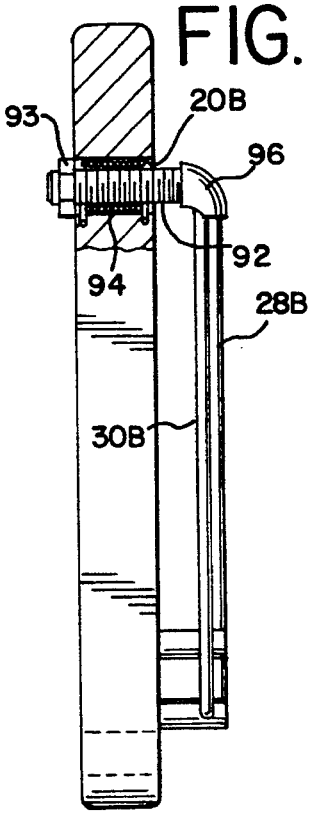
FIG. 7 is a side view, taken along the lines 7—7 of FIG. 6.
Figure 6:
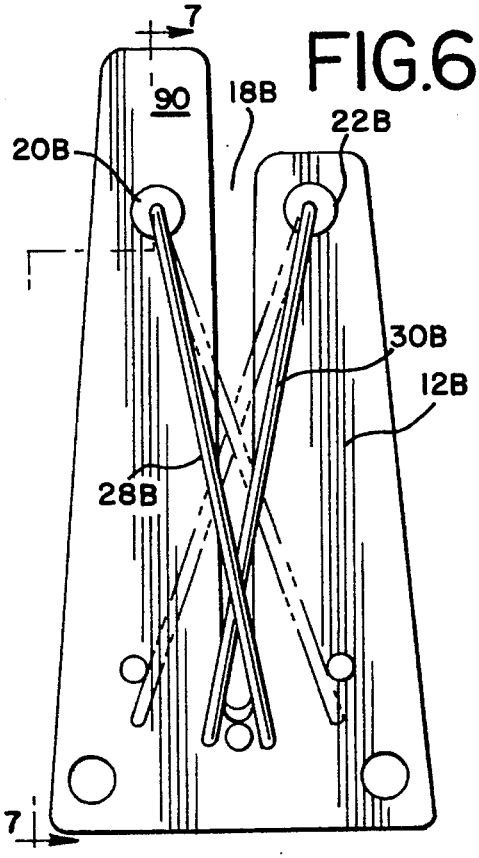
FIG. 6 is a front view illustrating a blade sharpening apparatus of another embodiment of the present invention.

Referring to FIGS. 6 and 7, another embodiment of a blade sharpening apparatus 90 incorporating the features of the present invention is illustrated. The blade sharpener 90 includes a base member 12B having a slot 18B disposed at a mid-portion thereof. The apertures 20B and 22B are located adjacent the slot 18B at an upper end thereof. The sharpening members 28B and 30B are formed from straight steel rods.

A pair of rotatable posts 92 are provided, with a post extending through each aperture 20B, 22B. Each post is threaded at both ends with a nut 93 secured over the post at the rear thereof, as illustrated in FIG. 7. A resilient biasing member in the form of a torsion spring 94 is shown mounted within the aperture 20 overlying and concentric with the post 92. The spring 94 is connected at one end to the post 92 and at the other end to the base member. An elbow 96 connects the post 92 to sharpening member 28B.

The operation of the blade sharpening apparatus of FIGS. 6 and 7 is substantially the same as that shown and described in FIGS. 1–3.

The above description of the invention is intended to be illustrative and not limiting. Various changes or modifications in the embodiment described may occur to those skilled in the art, and these can be made without departing from the spirit or scope of the invention.

Various features of the invention have been particularly shown and described in connection with the illustrated embodiments of the invention, however, it must be understood that these particular arrangements merely illustrate, and that the invention is to be given its fullest interpretation within the terms of the appended claims.

We claim:

1. A blade sharpening apparatus, comprising: a base member including a front face and a rear face; a slot defined in said base member adapted to receive and guide a blade to be sharpened; first and second apertures defined in said base member, one disposed on either side of said slot; first and second resilient biasing members, one disposed within each of said first and second apertures such that each of said biasing members are substantially entirely enclosed within said base member; first and second rear cover portions configured to overlie and seal said first and second apertures of said base member on said rear face thereof, a first sharpening member connected to said first resilient biasing member and rotatable about a central axis of said first aperture; a second sharpening member connected to said second resilient biasing member and rotatable about a central axis of said second aperture; whereby said resilient biasing members are oriented so as to urge said respective sharpening members to a first position in which each of said sharpening members lies across a plane passing through said slot, said sharpening members in said first position defining a V-shaped intersection therebetween, overlying said slot, said first and second resilient biasing members further operative to allow rotation of said respective sharpening members from said first position to a second position as said blade passes from one end of said slot toward the other as said blade is sharpened, and whereby said resilient biasing members are enclosed within said base member and protected from debris and contaminants.

2. The blade sharpening apparatus of claim 1 further including a pair of rotatable posts one extending from each of said first and second apertures, each post being connected to one of said resilient biasing members and one of said sharpening members, each post being operative to rotate said respective sharpening member.

3. The blade sharpening apparatus of claim 2 wherein said resilient biasing members consist of a torsion spring having one end connected to said base member and another end connected to said post.

4. The blade sharpening apparatus of claim 3 wherein said rotatable post includes a stem extending concentrically therefrom and disposed within said corresponding aperture, said torsion spring being mounted on and overlying said stem.

5. The blade sharpening apparatus of claim 4 wherein each of said rear cover portions includes a central bore configured to receive one end of said stem.

6. The blade sharpening apparatus of claim 4 including fastening means securing each of said rear cover portions to said stem thereby sealing the rear face of each of said apertures.

7. The blade sharpening apparatus of claim 1 including a flange located in each of said first and second apertures, extending from said base member, said flange having connecting means to allow for attachment of said corresponding resilient biasing means to said base member.

8. The blade sharpening apparatus of claim 2 wherein each of said posts includes a front cover portion configured to overlie and seal said respective apertures of said base member on said front face thereof.

9. The blade sharpening apparatus of claim 1 including stop means associated with said front face adapted to limit the rotational movement of said sharpening members.

10. The blade sharpening apparatus of claim 2 including a third sharpening member connected to one of said rotatable posts, positioned parallel to said first sharpening member but laterally spaced therefrom, so as to define a gap between said first and third sharpening members, said second sharpening member positioned to lie within said gap.

11. The blade sharpening apparatus of claim 1 including first and second wall members defined by said base member, said first and second wall members lying on opposite sides of said slot, with said first wall member being longer than said second wall member, so as to define a step against which a blade can be placed to assist in guiding a blade into said slot.

12. The blade sharpening apparatus of claim 1 wherein said first and second apertures are disposed toward the upper end of said slot and said first and second sharpening members extend downwardly across said slot.

13. The blade sharpening apparatus of claim 1 wherein said first and second apertures are disposed toward the lower end of said slot and said first and second sharpening members extend upwardly across said slot.

14. A blade sharpening apparatus, comprising: a base member including a front face and a rear face; a slot defined in said base member adapted to receive and guide a blade to be sharpened; first and second apertures defined in said base member, one disposed on either side of said slot, a pair of rotatable posts, one extending from each of said first and second apertures, each post having an end extending into its corresponding aperture; first and second resilient biasing members, one disposed within each of said first and second apertures such that each of said biasing members are substantially entirely enclosed within said base member, each resilient biasing member connected to said post within said aperture; a first sharpening member connected to one of said rotatable posts and rotatable about a central axis of said first aperture; a second sharpening member connected to said other of said rotatable posts and rotatable about a central axis of said second aperture; whereby said resilient biasing members are oriented so as to urge said respective sharpening members to a first position in which each of said sharpening members lies across a plane passing through said slot, said sharpening members in said first position defining a V-shaped intersection therebetween, overlying said slot, said first and second resilient biasing members further operative to allow rotation of said respective sharpening members from said first position to a second position as said blade passes from one end of said slot toward the other as said blade is sharpened, and whereby said resilient biasing members are enclosed within said base member and protected from debris and contaminants.

* * * * *